United States Patent [19]

Melillo et al.

[11] Patent Number: 4,550,907

[45] **Date of Patent: * Nov. 5, 1985**

[54] EXERCISING APPLIANCE

[76] Inventors: Anthony Melillo, 90 Boulderwood Dr., Bernardsville, N.J. 07924; Louis Gabriele, 39 Windgate Dr., Livingston, N.J. 07039

[ * ] Notice: The portion of the term of this patent subsequent to May 7, 2002 has been disclaimed.

[21] Appl. No.: 523,326

[22] Filed: Aug. 15, 1983

[51] Int. Cl.[4] ..... A63B 23/02

[52] U.S. Cl. ..... 272/93; 272/145; 272/900

[58] Field of Search ..... 272/93, 145, 900; 128/25 R, 75

[56] References Cited

U.S. PATENT DOCUMENTS

| | | | |
|---|---|---|---|
| 2,938,695 | 5/1960 | Ciampi | 128/75 |
| 3,134,592 | 5/1964 | Sharkey | 272/145 |
| 4,185,816 | 1/1980 | Bernstein | 272/93 |

OTHER PUBLICATIONS

Melillo, Gabriele, U.S. application Ser. No. 06/463992.

*Primary Examiner*—Richard J. Apley

*Assistant Examiner*—Kathleen J. D'Arrigo

*Attorney, Agent, or Firm*—Sherman & Shalloway

[57] ABSTRACT

A device is disclosed which may be used by a person in the performance of a variety of exercises. The device includes in a preferred embodiment a substantially rectangular member pivotally joined together with an elongated member at respective ends thereof. The rectangular member is designed to be placed under a mattress so as to be retained thereunder by frictional forces as well as by the weight of the mattress. An L-shaped locking member is slidably mounted on the elongated member and locks on the underside of the box spring to retain the device in a secured position. The elongated member further includes an adjustable bar preferably cantilevered in configuration which may be gripped by the hands or restrain the feet of the user in the performance of various exercises and further includes structure for displaying a variety of information. When the device is being used for exercising, the two members are pivoted to form about a 90° angle with one another and are retained in the position by retaining means. The members may be pivoted to a position adjacent one another and locked in this position for easy transport.

31 Claims, 13 Drawing Figures

257
219
217
211
203
200
407
409
337
300
325
325
327
327
400
221
229
231
201
229
231
207
207
221
110
110
116
116

400
337
419
229
200
229
257
203
221
119
114
407
221
114
112
417
215
113
160
124
403
317
315
301
325
325
327
313
327
300
170
170
128
128
122
123
170
170
126
128
128
120
100
127
125

EXERCISING APPLIANCE

BACKGROUND OF THE INVENTION

This invention constitutes an improvement over copending U.S. Pat. application Ser. No. 463,992 filed Feb. 4, 1983. Devices designed to assist a person in performing exercises are well known. U.S. Patent 1,953,857 to Hunter generally shows the combination of a foot holding device mounted on the support. U.S. Pat. No. 2,759,730 to Berry shows an exercising device which includes structure 30, 31 which could be construed as a support. U.S. Pat. Nos. 3,134,592 to Sharkey and 3,787,048 to Bock disclose devices for assisting a user in performing sit-ups in which the structure for supporting the feet is adjustable in height. U.S. Pat. No. 3,826,490 to Mossman discloses exercising equipment which includes a member 66 placed between the mattress and box spring for support. U.S. Pat. No. 4,182,509 shows a sit-up device including a base portion and footholding member, the device appearing to be intended to be placed under a door for support.

While some of these patents appear to show, in a quite general way, some of the features of the instant invention, none shows structure which comprises an entity with all of the features of the exercising apparatus disclosed herein.

SUMMARY OF THE INVENTION

Accordingly, it is an object of the present invention to provide an exercising appliance that is lightweight, portable, and which may include integral handle means for easy transport.

It is a further object of the present invention to provide an exercising appliance which, in a preferred embodiment, may have a portion thereof placed between a mattress and box spring or under a mattress to retain the appliance in a fixed location.

It is a further object of the present invention to provide an exercising appliance including a locking means secured under the box spring to securely fasten the appliance in a fixed position.

It is a still further object of the present invention to provide an exercising appliance including an adjustable, preferably, cantilevered bar which may be gripped by a person's hands or which may restrain a person's feet to enable exercises to be performed.

It is yet a further object of the present invention to provide an exercising appliance which includes indicating means which may indicate days, weeks, months, and/or years and may further indicate numerals corresponding to repetitions of various exercises.

These and other objects, advantages, features and aspects of the invention will become apparent upon reading the following detailed description of a preferred embodiment and upon reference to the accompanying drawings.

DESCRIPTION OF THE PREFERRED EMBODIMENT

Figure 1:
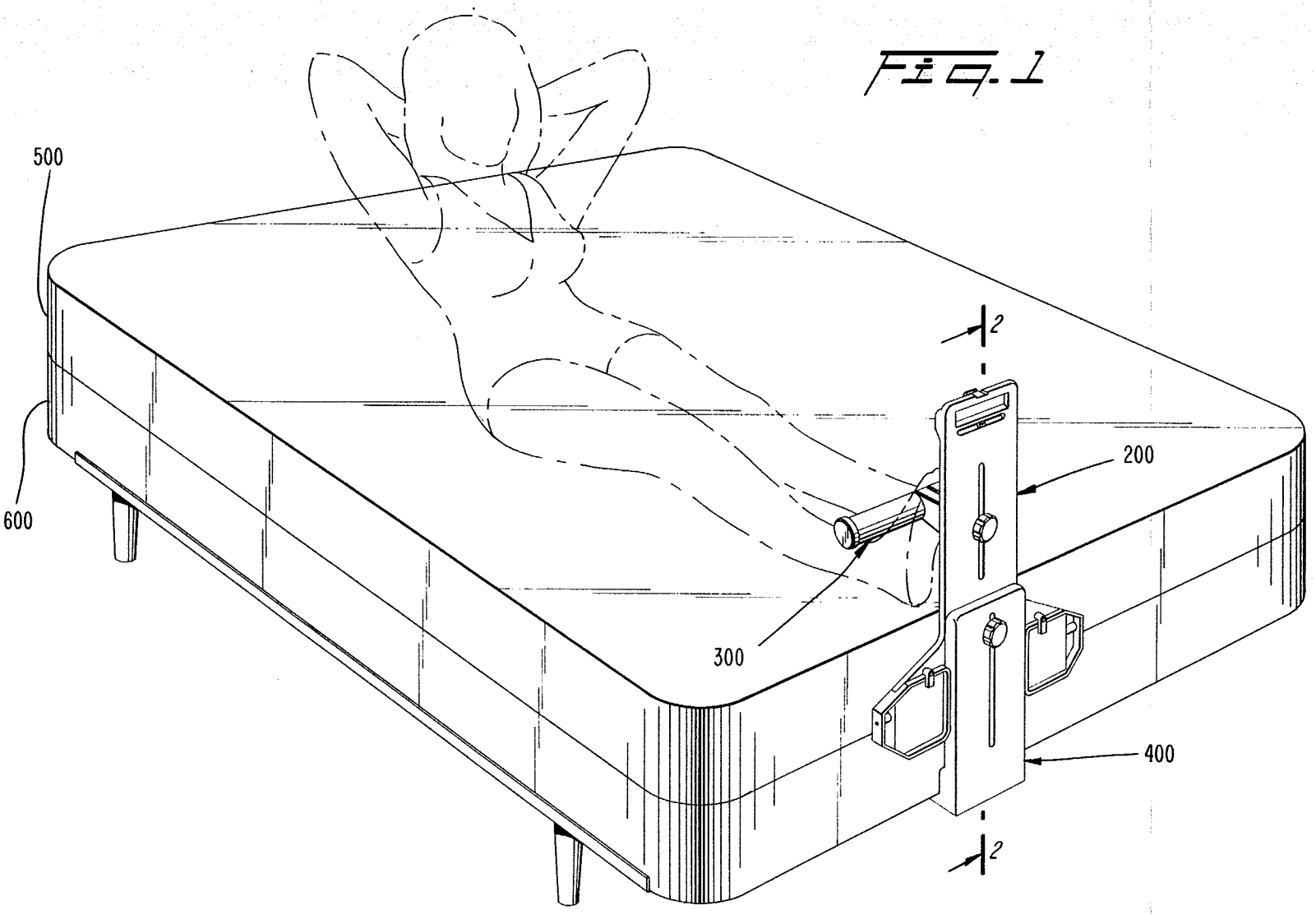
FIG. 1 shows a perspective view of the present invention as mounted between the mattress and box spring of a bed.

Referring to FIGS. 1—13, a device is shown which may be used to allow a person to perform a variety of exercises. FIGS. 1-5 in particular show the device locked in the open position by retaining means disclosed hereinafter. In the position shown, portion 100 is placed under a bed mattress 500 or between the mattress 500 and box springs 600 thereof (see FIGS. 11-12) so as to be fixed in position. Upstanding portion 200 extends upward from one edge of the mattress. Retaining bar 300 is adjusted to the desired height and fixed in position by retaining means and subsequently the desired exercises are performed.

Referring now to FIGS. 1-5 and 12-13 in particular, a specific description of the portion 100 will be given. Portion 100 is made in a generally rectangular shape and includes a base portion 110 and a portion 120 extending vertically therefrom. Base portion 110 includes thick portions 112 and portions 113 with holes 114 for a purpose explained hereinafter. Upstanding portion 120 further includes leg portions 122, 123, bottom portion 124 and upper portion 125. The upper, bottom and leg portions define an opening 126 which allows the mattress to bow into the portion 100 to aid in retaining the device in position. Upper portion 125, also includes a notch 127 for a purpose to be described hereinafter.

Figure 2:
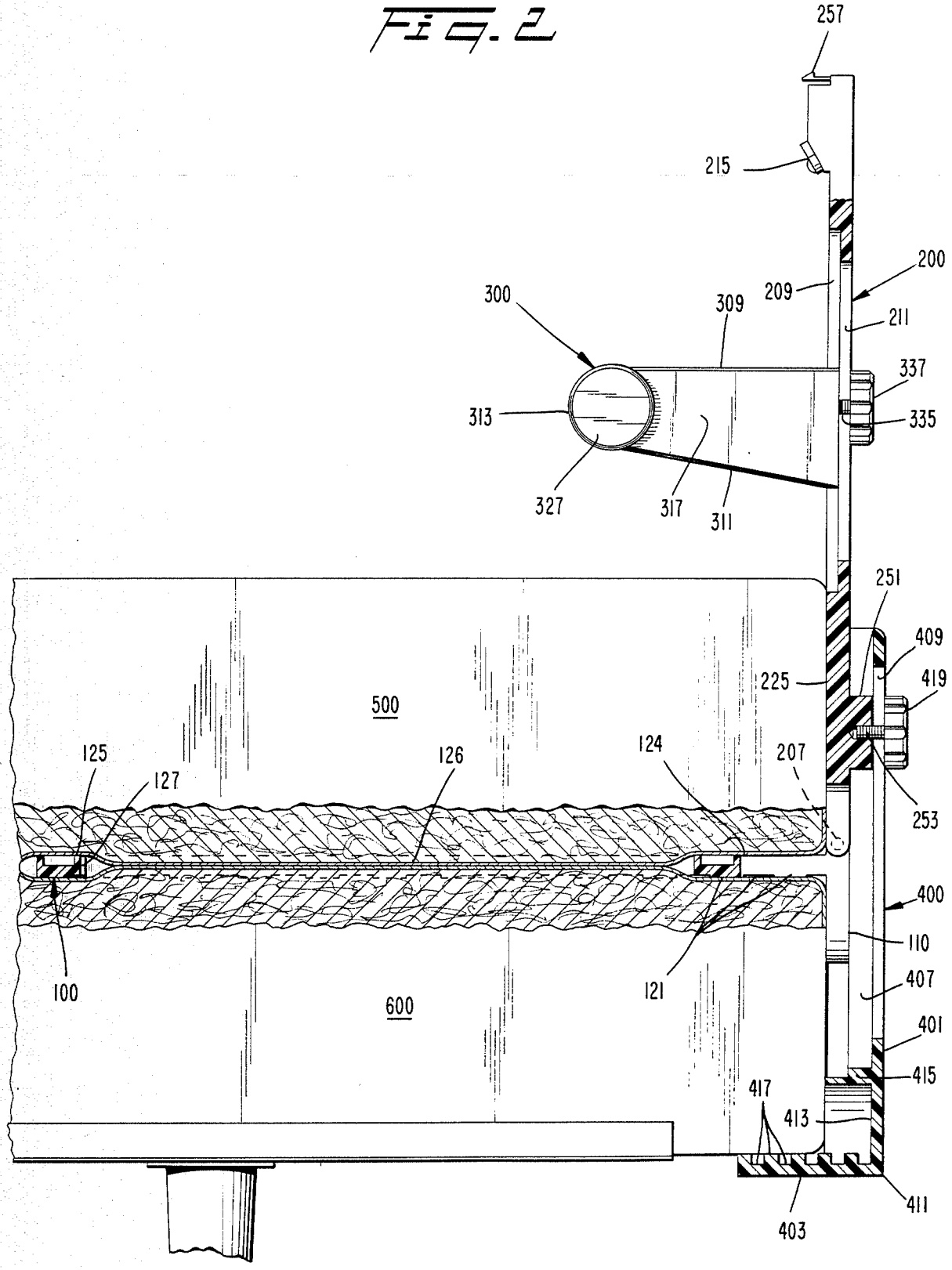
FIG. 2 shows a cross-sectional view along the line 2—2 of FIG. 1.
Figure 4:
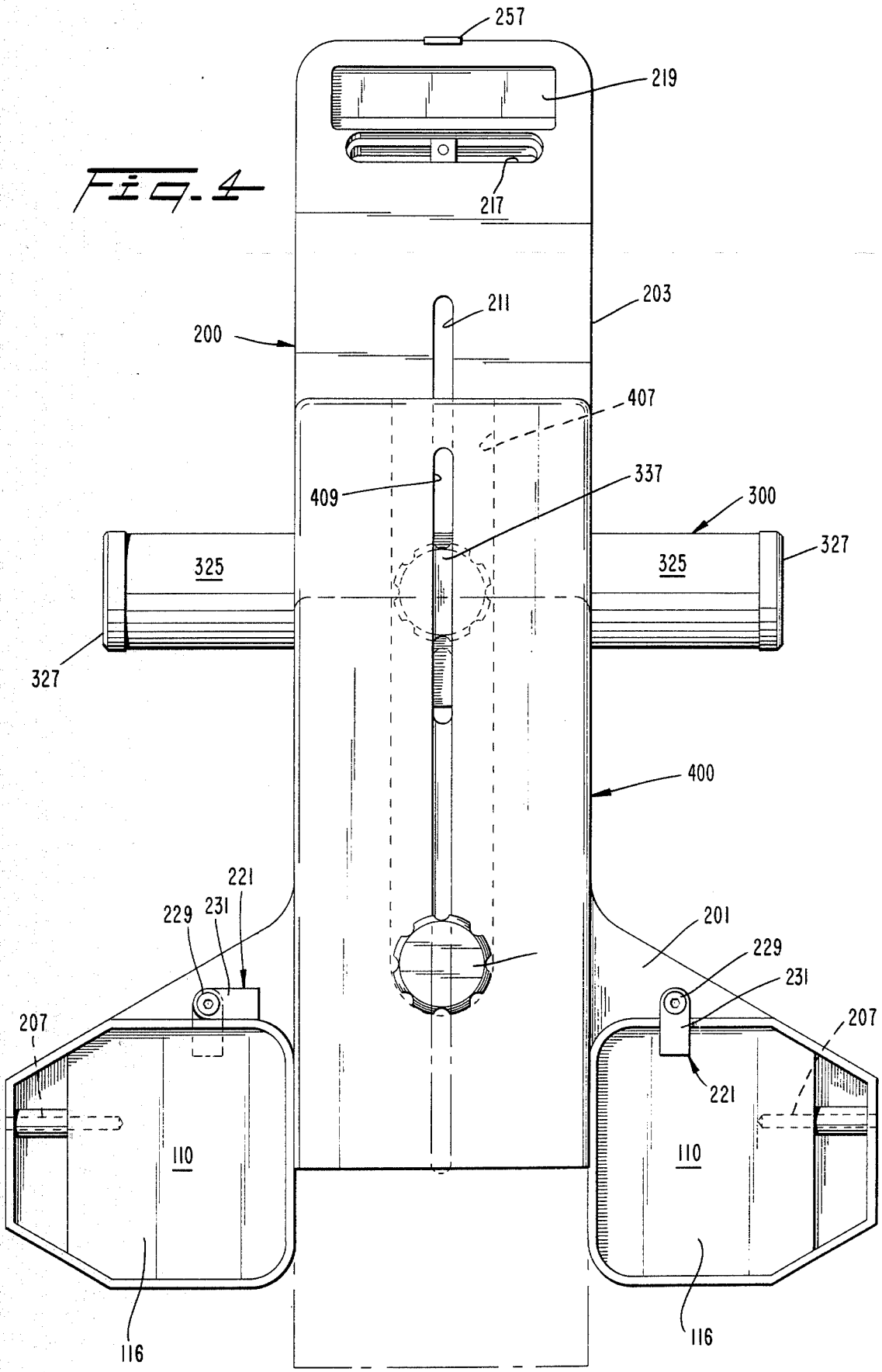
FIG. 4 shows a back view of the present invention in the open position.
Figure 5:
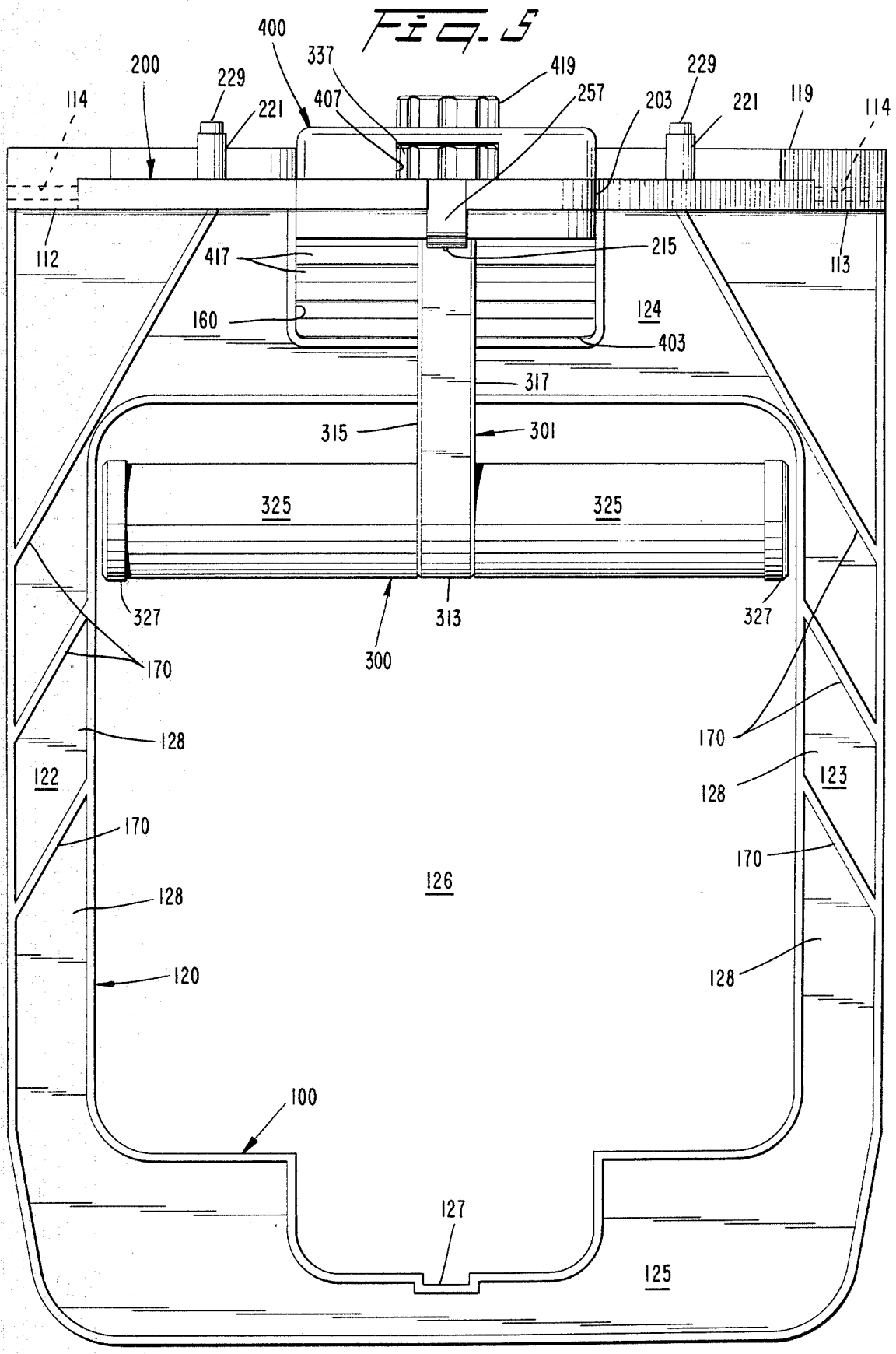
FIG. 5 shows a view looking downward onto the present invention in the open position.
Figure 6:
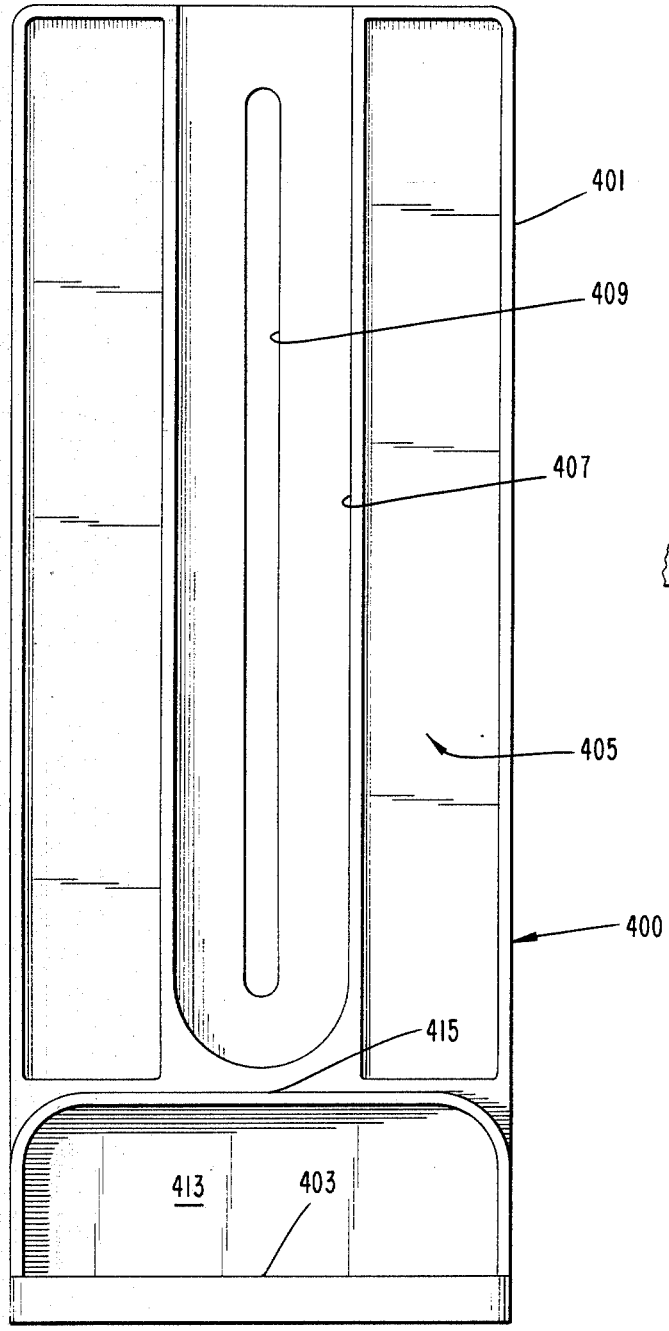
FIG. 6 shows a front view of the L-shaped locking device of the present invention.
Figure 7:
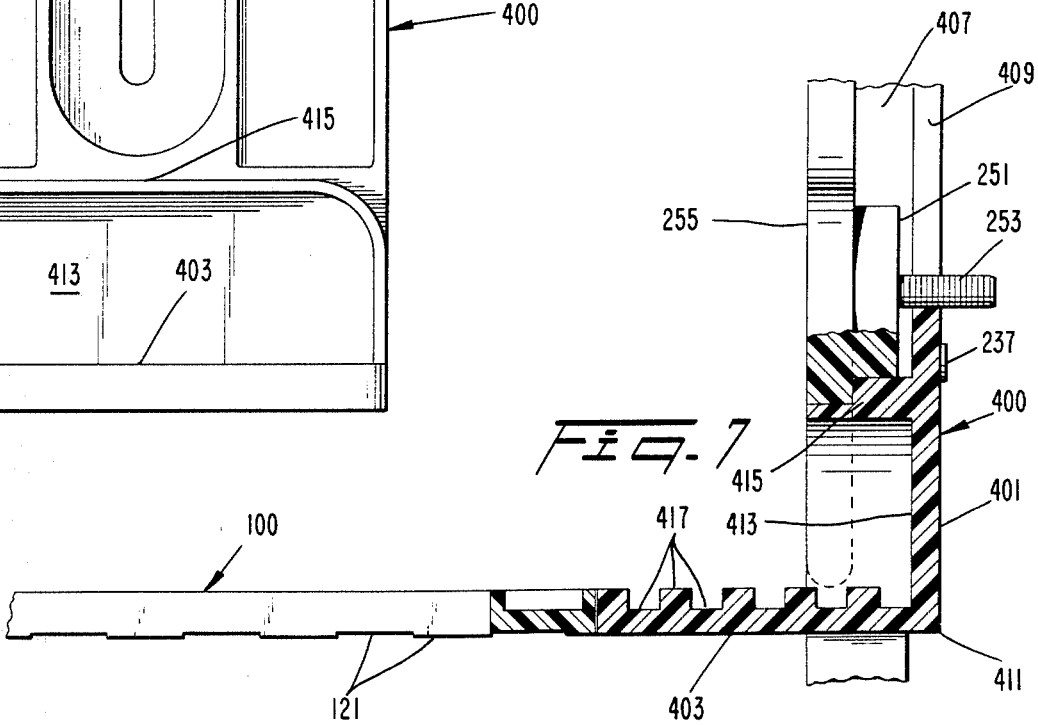
FIG. 7 shows a partial cross-sectional view along the line 7—7 of FIG. 3.
Figure 12:
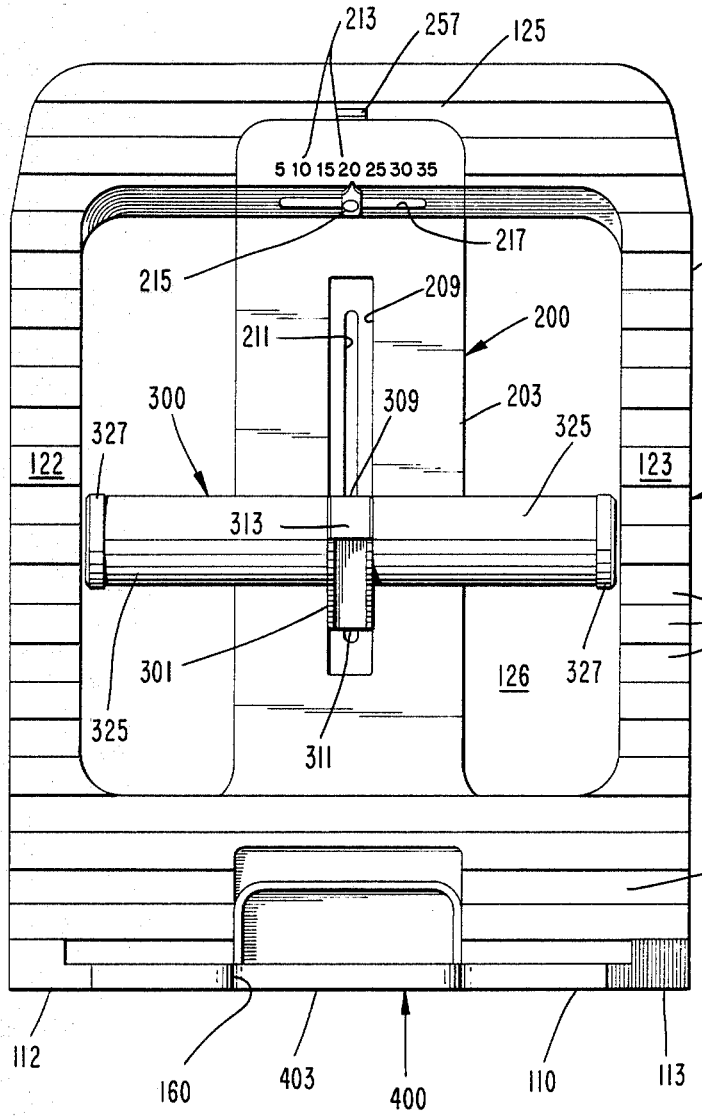
FIG. 12 shows a front view of the present invention in the closed position.
Figure 13:
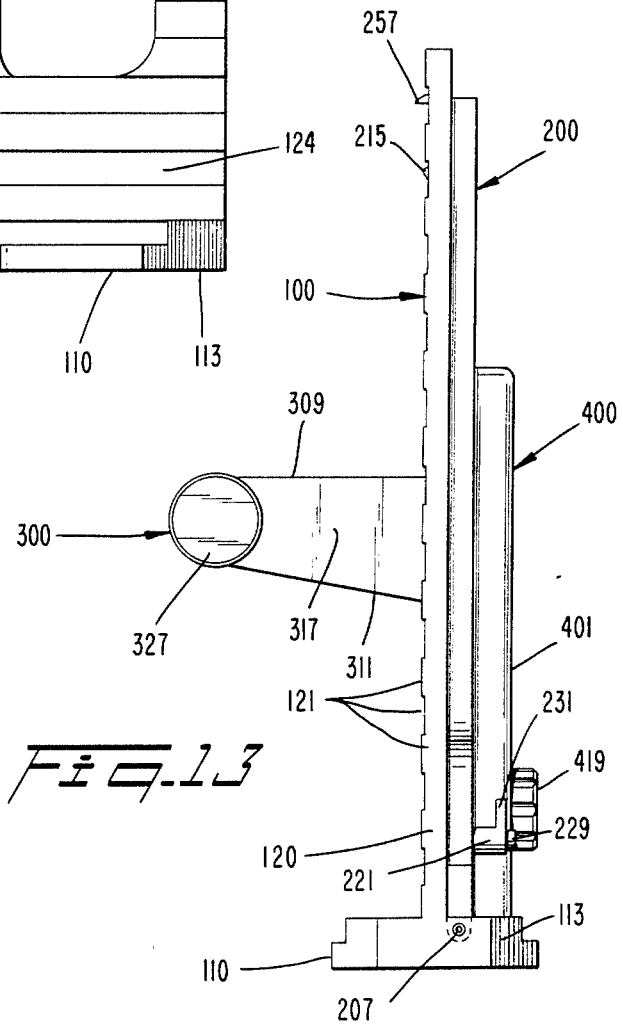
FIG. 13 shows a side view of the present invention in the closed position.

As best shown in FIGS. 4-5, the base portion as well as the vertical portion have slight recesses substantially throughout, the vertical portion 120 having recesses 128 bounded by diagonal ribs 170 and the base portion 110 having recesses 116. The recesses are included in the design of the various components of the device for four main reasons (1) the recesses make the device lighter and more easily transportable; (2) the recesses prevent warping of the device during and after the molding procedure; (3) the recesses on the upstanding portion 120 are specifically included to enhance the retention of the device under the mattress through creation of frictional forces; (4) the recesses spread stress forces throughout the components and thus allow greater forces to be exerted. As best shown in FIGS. 2, 7 and 12, the bottom of upstanding portion 120 has corrugations 121 thereon provided also for the four above noted purposes.

Figure 3:
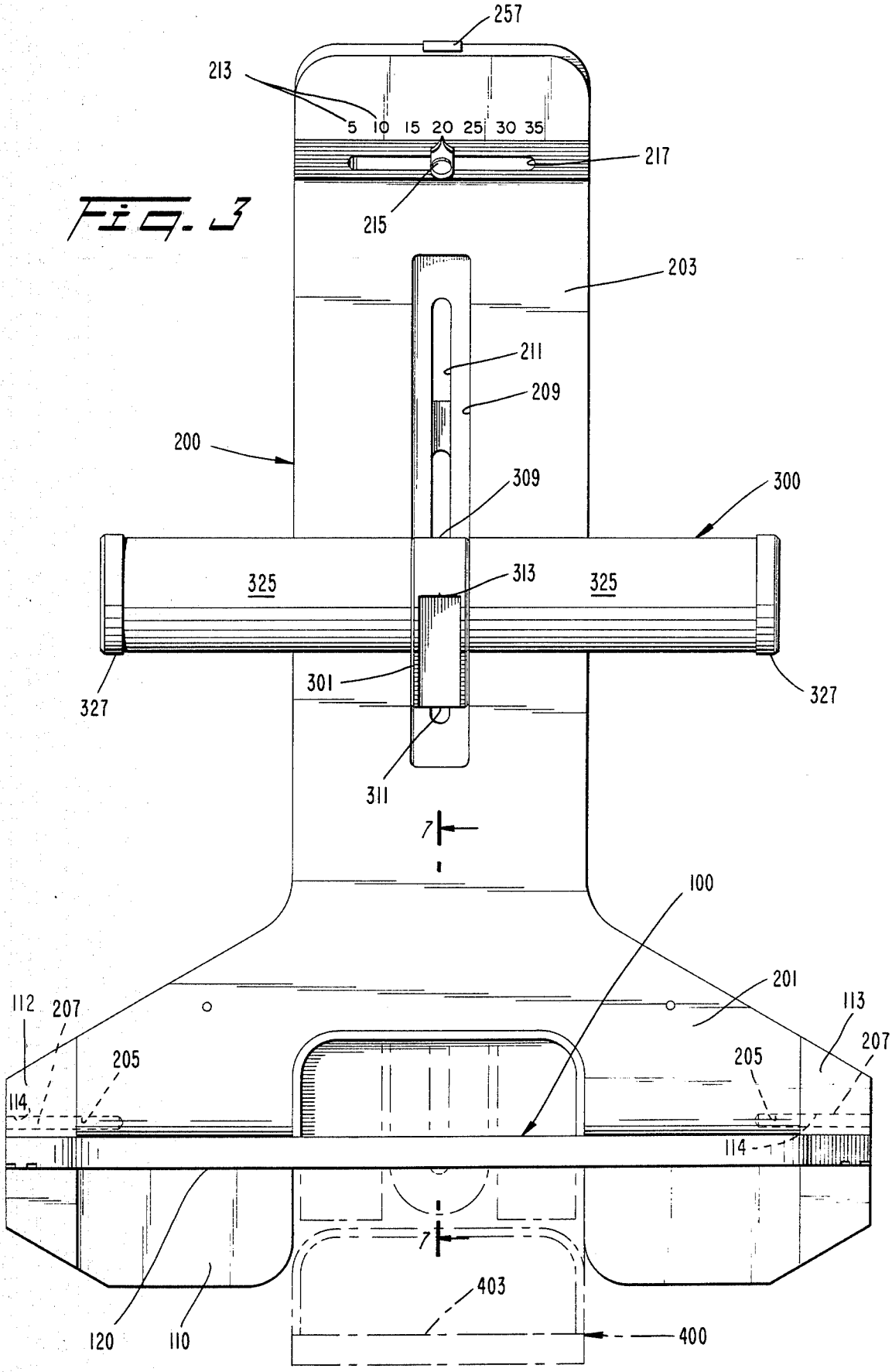
FIG. 3 shows a front view of the present invention in the open position.

Referring now to FIGS. 1, 3 and 4 in particular, the upstanding portion 200 includes a lower portion 201 and an upper portion 203. The lower portion 201, in assembly, is provided with holes 205 which align with holes 114 in portions 113. Pins 207 are placed in the respective holes 114, 205 to thereby pivotally mount the upstanding portion 200 to the portion 100. The upper portion 203 of upstanding portion 200 includes an elongated section in which are formed a depression 209 and a slot 211 for a purpose to be described hereinafter. Above the depression 209 and slot 211, indicia 213 are provided and an indicator pointer 215 is adjustable in slot 217 as desired to point to the desired indicia. On the opposite side of the portion 200, a recess 219 is provided which is gripped by a hand for transport purposes.

Figure 8:
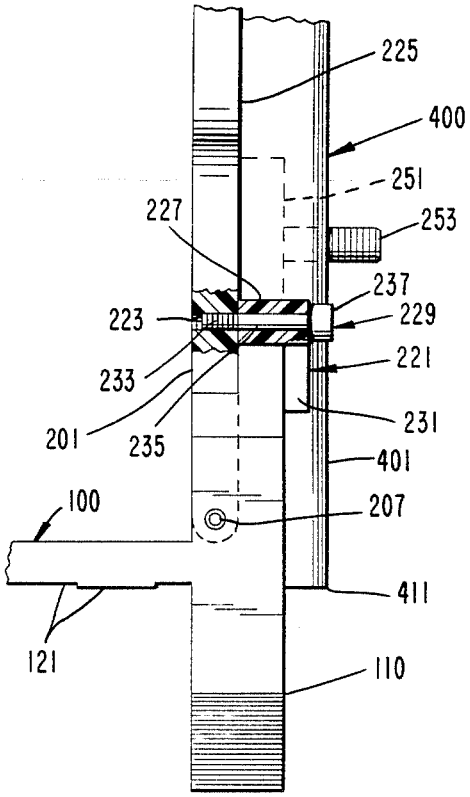
FIG. 8 shows a broken away view of the locking mechanism of the present invention.

As shown in FIGS. 1, 4, 8 and 13 the upstanding portion 200 carries a pair of eccentric safety locks 221 the purpose of which is to retain the upstanding portion 200 in an orientation substantially perpendicular to the base portion 100. As shown in FIG. 8, threaded holes 223 are located on side 225 of portion 200. The locks 221 each comprise a post portion 227 including a hole therethrough for receipt of a shoulder screw 229 which threads into a respective hole 223. Extending substantially radially outwardly from post portion 227 is a catch 231. As best shown in FIG. 4, after the portion 200 is pivoted to a substantially perpendicular position with respect to base 100, the locks 221 are pivoted so that the catches 231 overlie the bottom of the base 110 to thereby retain the device in this configuration. The screws include a threaded portion 233, a body portion 235 and a head 237. The body portion is made of a length slightly longer than the post 227 so that with the threaded portion installed and the head overlying the post, sufficient clearance is provided to enable turning of the lock 221.

Referring now in particular to FIGS. 2, 3 and 9–11, the retaining bar means 300 is seen to include an arm 301 preferably made, as shown of a cantilevered shape. If desired, however, this arm may be made cylindrical, cubical, a rectangular solid-like or in any other desired shape. As shown, the arm includes an end 303 having a width 305 designed for slidable fit into the above described depression 209 and having a length 307 greater than its width 305. Extending from this first end 303 are a first perpendicular side 309 and a second angular side 311 which converge at a radiused further end 313. The sides 309, 311 are connected with one another through flat parallel faces 315, 317. Extending perpendicularly outwardly from faces 315, 317 in the region of further end 313 are core members 319. Each such core member 319 includes a central portion 321 and 323 circumferentially spaced ribs exlending outwardly therefrom. As further shown, each core member is covered by a flexable cover 325 which is preferably made of polyurethane or other foam-like plastic substance. It is noted that any flexible material may be used for covers 325. For example, leather covered foam rubber, or a rubber compound may be used. As further shown in FIGS. 9–10 end caps 327 are provided which overlie the end portions of covers 325 and the core members 319 and which further include projections 329 which are dimensioned for a press fit into core member holes 331. As shown the end caps include lip portions 333 which gently squeeze the end portions of the covers against the respective core members to aid in the retention thereof.

Figure 11:
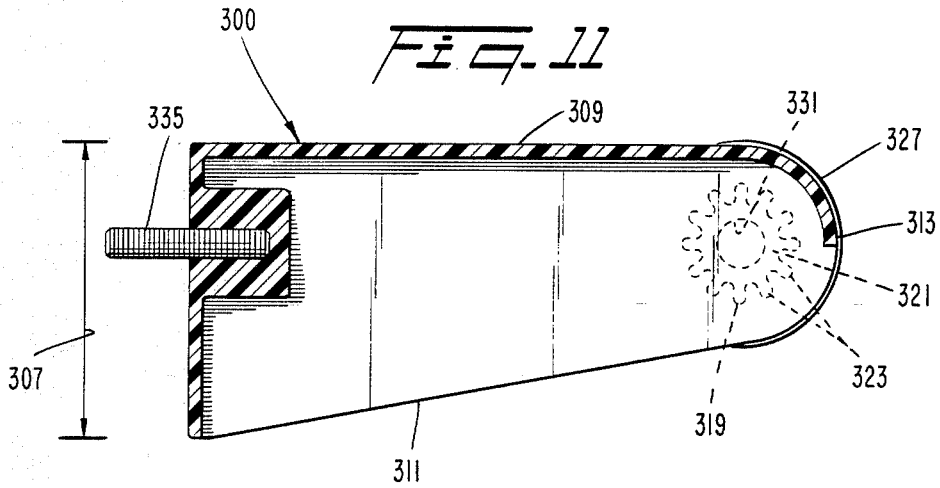
FIG. 11 shows a cross-sectional view along the line 11—11 of FIG. 10.
Figure 9:
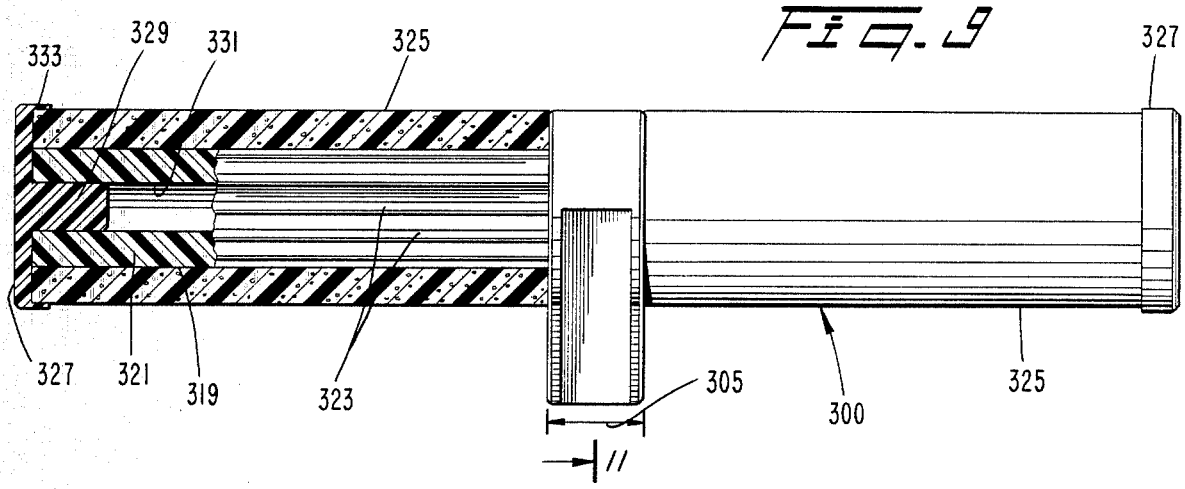
FIG. 9 shows an end view of the cantilevered retaining bar of the present invention partially broken away to show detail.
Figure 10:
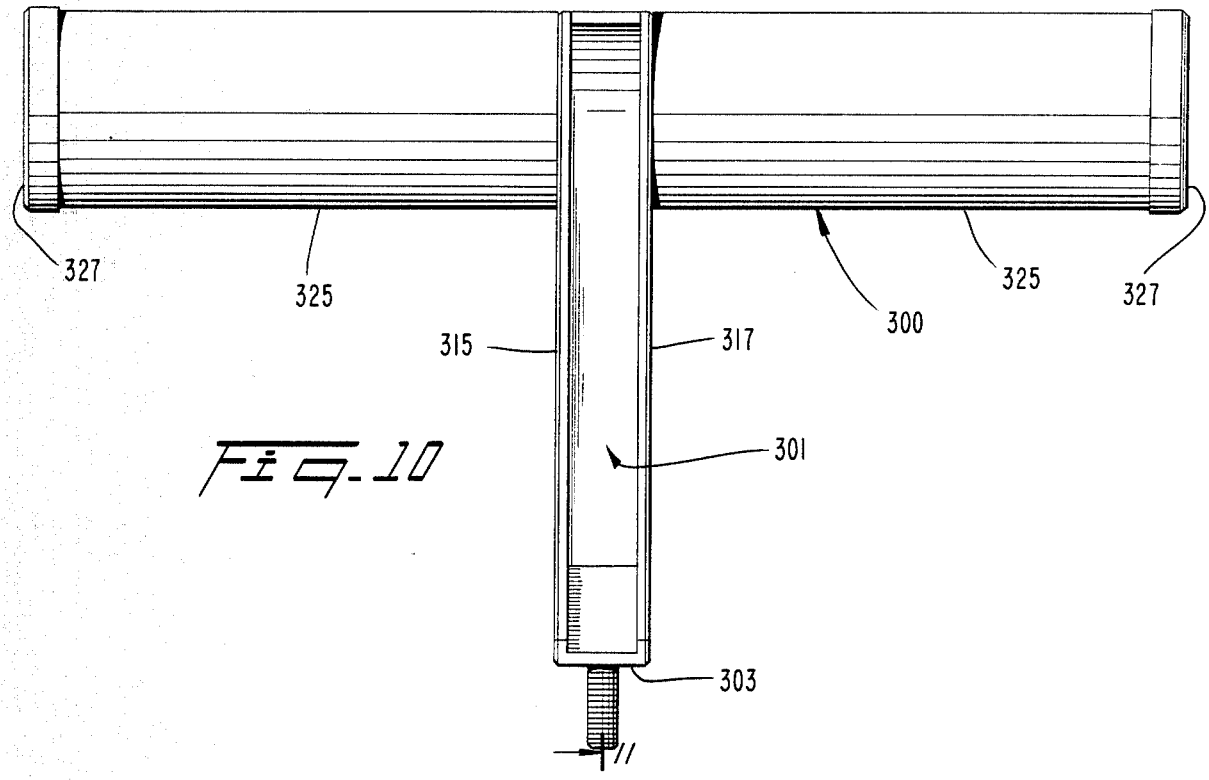
FIG. 10 shows a bottom view of the bar of FIG. 9.

With reference now to FIG. 11 it is seen that a threaded stud 335 protrudes outwardly from the end 303 of the arm 301. This stud, in assembly, extends through the slot 211 and a knob 337 with hole threaded corresponding to stud 335 is threaded over the stud and frictionally engages a side 225 of the upstanding portion 203 remote from the side including depression 209 to thereby retain the arm 300 in fixed assembly at a desired location on the upstanding portion 200. The interaction between the end 303 of the arm, the depression 209, the stud 335 and the knob 337 allows for infinite adjustment of the position of the cantilevered bar 300 along the entire length of the slot 211.

Referring now to FIGS. 1-2, 4, 6-7 and 13 an L-shaped locking device 400 is mounted on the side 225 of the portion 200. As shown in FIG. 2, the side 225 has extending therefrom a post 251 with a stud 253 protruding therefrom. The locking device 400 includes a first leg 401 and a second shorter leg 403. The first leg has a face 405 into which depression 407 is formed. A slot 409 extends from the depression 407 completely through the first leg 401. Shorter leg 403 attaches to the first leg at 411 and extends from the face 413 substantially perpendicularly thereto. Adjacent the attachment point 411, a stepped equalizer portion 415 is formed which protrudes from the face 413. This equalizer 415 is provided so that when the appliance is attached to the box spring with locking device 400, the equalizer will be flush with the box spring and the face 255 of the portion 200 will be flush with the mattress 500. The shorter leg 403 is designed to fit under the bottom of the box spring 600, and has small corrugations 417 on the bottom thereof. The locking device is assembled to the portion 200 with the post 251 slidably fitting into depression 407 and the stud 253 extending completely through the slot 409. A knob 419 with threaded hole corresponding to the threads on stud 253 is threaded over the stud 253 and frictionally engages face 421 of the leg 401 to retain the locking device in a predetermined fixed position. This relationship between the post 251, depression 407, stud 253 and knob 419 enables infinite adjustment of the position of the locking device 400 so that the appliance may be attached to any size of mattress and/or box spring combination.

As stated earlier, cantilevered arm retention knob 337 frictionally engages face 225 of portion 200. The depression 407 of leg 401 is given sufficient width and depth so as to provide minimal clearances around the knob 337. Thus, the locking device 400 may be infinitely adjusted throughout the length of slot 409 without interference from a knob 337.

When the device is locked by the notch 127 and protrusion 257 for transport, the device may be supported in a standing position on the base portion 110 which has a flat bottom 119. A recess 160 (FIGS. 12–13) is provided in the base portion of a size to receive the shorter leg 403 of the locking device 400. As such during transport, the locking device may be reciprocated to the position shown in FIGS. 12–13 so that the leg 403 is completely enclosed by recess 160 so that the base portion 110 will support the device in the standing position without interference from the shorter leg 403.

The material used to manufacture portions 100, 200, 300 and 400 may be any suitable material, for example, high impact styrene plastic. Any material having durability, shatter resistance and low weight would be suitable. Resilient cover member 325 may be made of any soft, flexible material. For example, polyurethane and polypropylene have been found to be suitable. Portions 100, 200, 300, 400 may be made of wood, aluminum, fiberglass, etc., as well as plastic. In the preferred embodiment portions 100, 200, 300, 400 are made of styrene in an injection molding process whereas cover 325 is made of polyurethane.

The portion 100 is designed to be sufficiently long so that the desired leverage to retain the device in place is achieved. Experiments have led to the conclusion that the optimum length for portion 100 is about 20–22 inches. The opening 126 must be sufficiently large so as to (1) prevent warping of the portion 100 and (2) enhance the retention forces acting thereon when installed under a mattress.

The upstanding portion is made sufficiently lengthy to accommodate to differing thicknesses in mattresses and to provide sufficient adjustability of retaining bar 300. The width thereof is also designed so as to accommodate differing leg thicknesses.

The types of exercises which may be performed with this invention are limited only by the user's imagination. Examples of exercises: (1) sit-ups by hooking the feet under the bar; (2) leg lifts by lying on one's back and grasping the bar by raising the arms over the head; (3) squats by standing on the floor adjacent the bed, and grasping the bar with the hands; (4) retaining a single foot under the bar while lifting the other leg.

Thus, it is apparent that there has been provided in accordance with the invention a unique exercising appliance that fully satisfies the above mentioned objects. While the invention has been described with reference to a single embodiment, the invention is intended to embrace all alternatives, modifications and variations which will be apparent to those skilled in art in view of the foregoing description and should only be construed as limited by the following claims.

We claim:

1. An exercising appliance comprising a first portion and a second portion, said first and second portions being pivotally connected to one another at a pivot axis located at respective ends of said portions, said first portion including:

(a) first means including corrigation adapted to frictionally retain said first portion in a substantially fixed position when said first portion is placed in a confined space; and (b) second means adjacent said pivotally connected end for limiting the movement of said first portion into said confined space to a pre-determined distance;

said second portion including guide means substantially centrally located thereon and (c) bar means mounted on said second portion including:

(i) third means interengaging with said guide means to allow slidable movement of said bar means with respect to said guide means; and (ii) fourth means adapted to interengage with said spaced third means to lock said bar means into pre-determined positions.

2. The exercising appliance of claim 1, wherein said second means limits pivotal movement of said first and second portions with respect to one another to an angular displacement therebetween of approximately 90°.

3. The exercising appliance of claim 2 wherein said second means further includes an underside and said second portion further includes pivoting means which is pivotal to overlie said underside when said first and second portions are displaced at approximately 90° apart to releasably retain said first and second portions at said displacement of approximately 90°.

4. The exercising appliance of claim 3 wherein said pivoting means comprises pivoting first lock means.

5. The exercising appliance of claim 3, wherein said first portion further includes notch means and said second portion further includes projection means, said projection means interengaging with said notch means when said first and second portions are pivoted to a substantially parallel configuration to thereby releasably retain said first and second portions in said substantially parallel configuration.

6. The exercising appliance of claim 5, wherein said pivoting means and said projection means are located on opposite faces of said second portion.

7. The exercising appliance of claim 1, wherein said corrugations run substantially parallel to said pivot axis.

8. The exercising appliance of claim 1, wherein said confined space is defined by the space between a mattress and a bed and said corrugations are defined on leg means surrounding an opening in said first portion, said mattress bowing into said opening.

9. The exercising appliance of claim 8, wherein said bed includes a box spring and said confined space is defined by the space between said mattress and said box spring.

10. The exercising appliance of claim 9, further comprising lock means mounted on said second portion and adapted to extend under said box spring to securely lock said appliance in a fixed position.

11. The exercising appliance of claim 10, wherein said lock means is reciprocally mounted on said second portion.

12. The exercising appliance of claim 11, wherein said lock means is L-shaped in configuration and comprises:

(a) a first vertical leg reciprocally mounted on said second portion, and (b) a second horizontal leg connected to an end of said first leg and adapted to be placed under said box spring whereupon said first leg is reciprocated to tightly secure said second leg under said box spring.

13. The exercising appliance of claim 12, wherein said second portion has extending therefrom a protruding guide post which has a threaded stud extending therefrom, said first leg includes a first face facing said guide post, said face including an elongated depression sized to slidably receive said guide post and said elongated depression includes slot means extending through said first leg and adapted to receive said threaded stud, and further comprising threaded retaining means adapted to be threaded onto said threaded stud and into frictional engagement with a second face of said first leg to thereby retain said lock means in a position which secures said appliance.

14. The exercising appliance of claim 13, wherein said lock means enables said appliance to be securely fastened to mattresses and/or box springs of variable thicknesses and heights.

15. The exercising appliance of claim 14, wherein said first portion second means acts as a base to support said appliance when in a closed position, said first portion second means including a recess sized to receive said second horizontal leg completely therein when said lock means is telescoped to its uppermost position.

16. The exercising appliance of claim 1, wherein said first and second portions and said bar means are formed by injection molding of plastic.

17. The exercising appliance of claim 1, wherein said bar means includes a core member and cover means, said core member extending on opposed sides of bar means support means.

18. The exercising appliance of claim 17, wherein said core member includes circumferentially spaced ribs, said cover means being formed of a resilient material, said cover means being stretched over said core member.

19. The exercising appliance of claim 18, wherein said cover means comprises a plurality of cover members stretched over separate portions of said core member.

20. The exercising appliance of claim 19, further include cap means overlying end portions of said cover members and frictionally extending into said core member to thereby retain in position said cover members.

21. The exercising appliance of claim 17, wherein said bar means support means comprises a cantilevered arm member connected on one end to said core member and another end of said arm member comprising said third means.

22. The exercising appliance of claim 21, wherein said second portion guide means comprises:

(a) a depression sized to slidably receive said another end of said cantilevered arm; and (b) an elongated slot located in said depression.

23. The exercising appliance of claim 22, wherein said another end of said cantilevered arm includes threaded stud means extending therefrom, an end of said stud means extending completely through said elongated slot when said another end of said cantilevered arm is slidably positioned in said depression.

24. The exercising appliance of claim 23 wherein said fourth means comprises knob means threaded onto said stud means, said knob means frictionally engaging a side of said second portion remote from said depression to thereby retain said bar means in a desired position.

25. The exercising appliance of claim 24, wherein said lock means is reciprocally mounted on said second portion.

26. The exercising appliance of claim 25, wherein said lock means is L-shaped in configuration and comprises:

(a) a first vertical leg reciprocally mounted on said second portion, and (b) a second horizontal leg connected to an end of said first leg and adapted to be placed under said box spring whereupon said first leg is reciprocated to tightly secure said second leg under said box spring.

27. The exercising appliance of claim 26, wherein said second portion has extending therefrom a protruding guide post which has a threaded stud extending therefrom, said first leg includes a first face facing said guide post, said face including an elongated depression sized to slidably receive said guide post and said elongated depression includes slot means extending through said first leg and adapted to receive said threaded stud, and further comprising threaded retaining means adapted to be threaded onto said threaded stud and into frictional engagement with a second face of said first leg to thereby retain said lock means in a position which secures said appliance.

28. The exercising appliance of claim 27, wherein said second portion first face depression is sized to receive in spaced relation said fourth means comprising said knob means.

29. The exercising appliance of claim 1, wherein said second portion further includes a top portion including display indicia.

30. The exercising appliance of claim 1, wherein said first and second portions are pivotally connected by pin means extending therebetween.

31. The exercising appliance of claim 1, wherein said first portion includes cavity means formed at an end opposite said pivotally connected end which forms handle means.

* * * * *